United States Patent [19]

Iten

[11] 4,167,059

[45] Sep. 11, 1979

[54] DISPOSABLE RAZOR

[76] Inventor: Clemens A. Iten, 235 Overlook Rd., Staunton, Va. 24401

[21] Appl. No.: 895,552

[22] Filed: Apr. 12, 1978

[51] Int. Cl.[2] ..... B26B 21/06

[52] U.S. Cl. ..... 30/32

[58] Field of Search ..... 30/32, 85, 86, 62, 339, 30/40; D28/48, 49

[56] References Cited

U.S. PATENT DOCUMENTS

| | | | |
|---|---|---|---|
| D. 119,186 | 2/1940 | Martin | D28/49 |
| 1,563,674 | 12/1925 | Stuart | 30/339 X |
| 2,345,492 | 3/1944 | Miller | 30/62 |
| 3,078,569 | 2/1963 | Sidney | 30/32 |

FOREIGN PATENT DOCUMENTS

| | | | |
|---|---|---|---|
| 125895 | 5/1919 | United Kingdom | 30/62 |

*Primary Examiner*—Jimmy C. Peters

*Attorney, Agent, or Firm*—Gajarsa, Liss & Conroy

[57] ABSTRACT

A disposable type razor in which a handle part and a blade carrier are formed of one-piece molded construction, the handle having a generally semi-circular lower body configuration which tapers in diminishing width toward one end on which is mounted the blade carrier.

10 Claims, 10 Drawing Figures

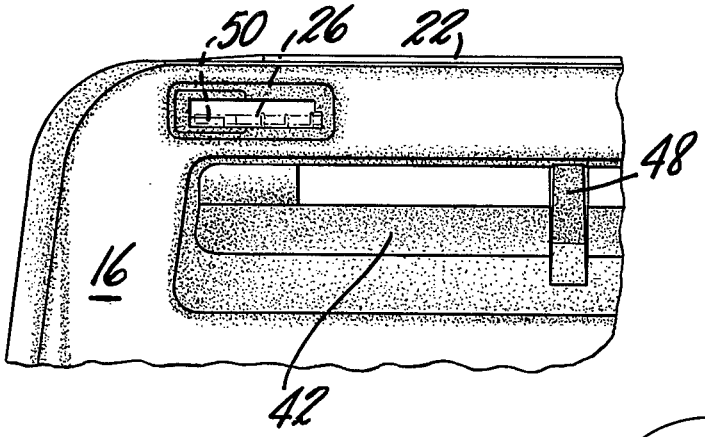
FIG. 7
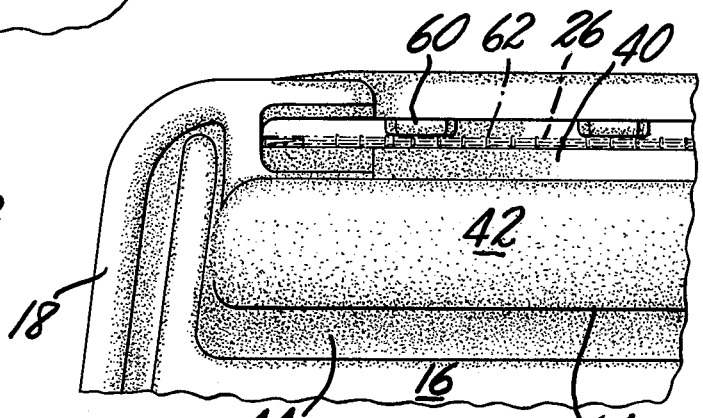
FIG. 8
FIG. 9
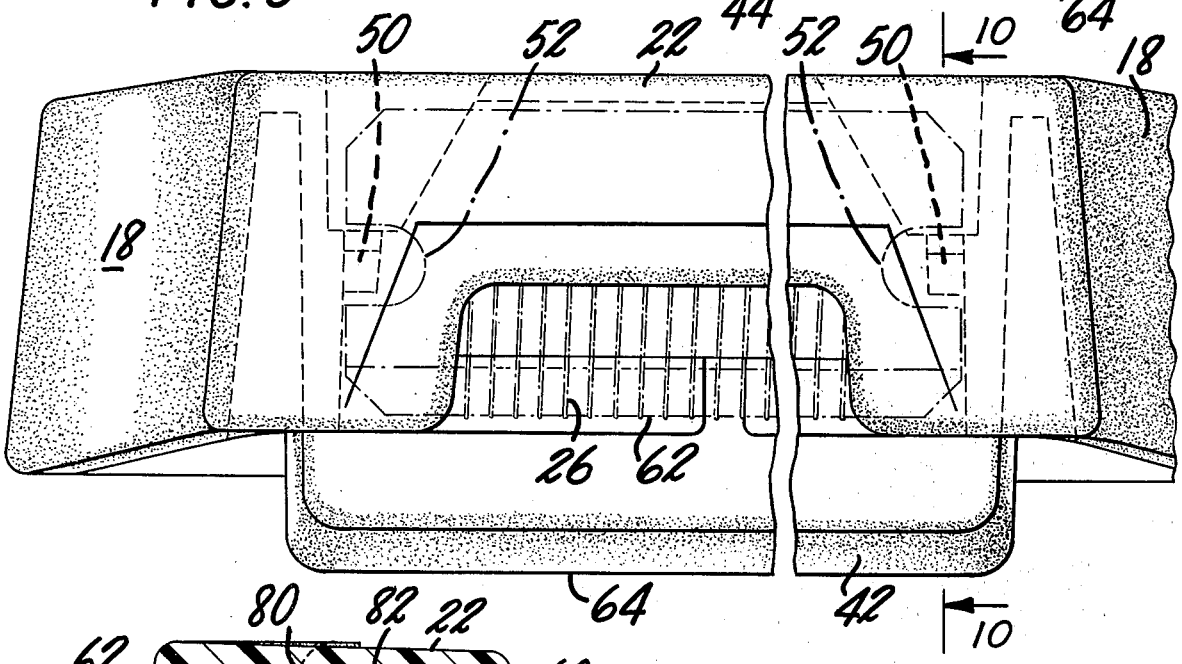
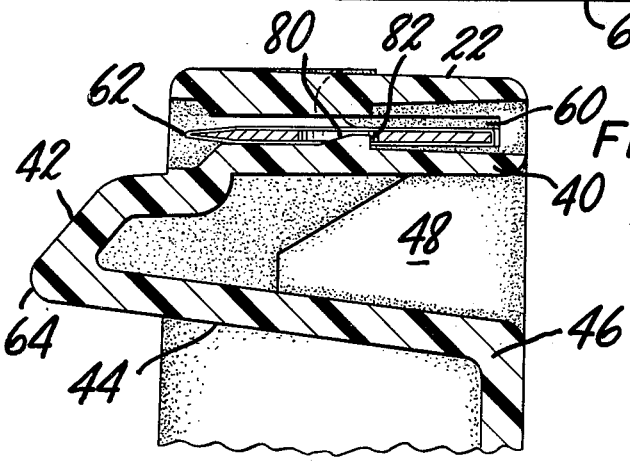
FIG. 10

DISPOSABLE RAZOR

BACKGROUND OF THE PRESENT INVENTION

Disposable type razors are becoming more popular and widespread in use, and this is particularly true in respect of razors intended for use by women. Many forms of disposable razors are known in the prior art, such disposable razors in most instances generally having the appearance and structural features of reuseable or blade change types of razors.

The present invention relates to an inexpensive, easily manufactured, disposable type razor that is especially designed and suited for use by women. The razor is constructed of lightweight, thin gauge thermoplastic material but yet embodies features which provide a very rigidized blade mounting therein. Moreover, the razor is easy to hold in shaving position, is small and compact in size and has an attractive appearance.

SUMMARY OF THE INVENTION

The disposable type razor of the present invention is embodied in a structure having a handle part and a blade carrier, the carrier and handle part being of integral one-piece molded thermoplastic material construction. The handle part has an elongated relatively wide-surfaced rear panel having a semicircular configuration at one, i.e., the lower end thereof, which panel extends with diminishing lateral expanse in the direction of the other or shaving end and at which is mounted the blade carrier. Additionally, the razor includes a skirt encircling the periphery of the panel and extending frontally therefrom, with the skirt and panel terminus at the said other or upper end being disposed transversely of the long axis of the elongated panel. The blade carrier is mounted at the narrower or upper end of the razor adjacent, such end including a blade holder which is arranged parallel with the panel and skirt end terminus, the blade holder having a blade platform upon which is received a single edge razor blade of conventional construction, there further being a guard member extending frontally of the blade platform. Means are embodied on the platform and skirt other end terminus for maintaining the blade in fixed relationship to the guard component.

To enhance the rigidity of the overall razor structure, the panel is provided with a plurality of stiffening rings which extend frontally from the panel and which are arranged concentric one with the others and with the rounded skirt portion at the lower end of the panel. Disposed within the centermost stiffening ring, is a pattern of radially directed ribs which appear at both the front and rear sides of the panel to enhance the overall appearance of the razor. Additionally, the centermost ring defines a centrally located depressed portion in the razor structure which provides a finger hold region with which the razor can be grasped and held in shaving position during use.

For maintaining the blade fixed within the blade carrier, there are provided lugs at opposite ends of the blade platform which are engageable with notches carried in opposite ends of the blade and projections carried at spaced locations on the inner surface of the skirt other end terminus which engage with the blade for urging it against the blade platform.

A debris removal feature is provided in the razor and comprises an elongated slotted opening formed in the panel adjacent the upper end of the razor and a series of debris openings in the blade holder adjacent and rearwardly of the guard which communicate with the slotted opening to thus define a shaving debris flow course as well as a rinsing path for cleaning the razor. Additionally, support ribs extend between the blade platform and a spaced wall part of the blade holder to further enhance the overall structural character of the razor.

A safety feature is incorporated in the structure which permits insertion of the blades from the front opening of the razor. The blade is then prevented from forward movement and from resulting injury to the user.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings in which:

FIG. 7 is a fragmentary rear elevational view of an upper corner portion of the razor depicting the manner in which the razor blade is received on the blade platform and held by lug structure therein.

FIG. 8 is a fragmentary elevational view of an upper corner of the razor as viewed from the front side showing the manner in which the razor blade is held securely on the blade platform by the blade holding lugs.

FIG. 9 is a top plan view of the razor showing the relative positioning of the razor blade in the blade carrier.

FIG. 10 is a vertical sectional view taken along the line 10—10 in FIG. 9.

Throughout the description like reference numerals are used to denote like parts in the drawings.

DESCRIPTION OF THE PREFERRED EMBODIMENTS

With reference to FIGS. 1–5, various constructional features of the disposable razor will be discussed.

Figure 4:
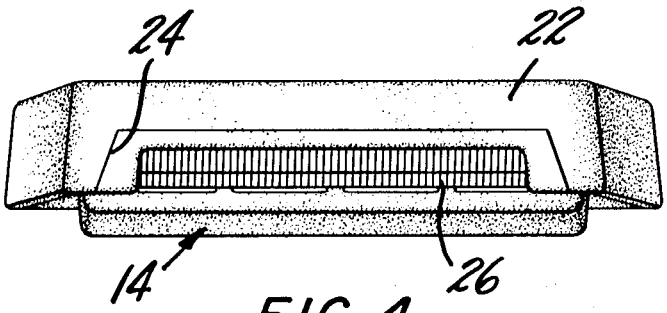
FIG. 4 is a top plan view of the razor.
Figure 5:
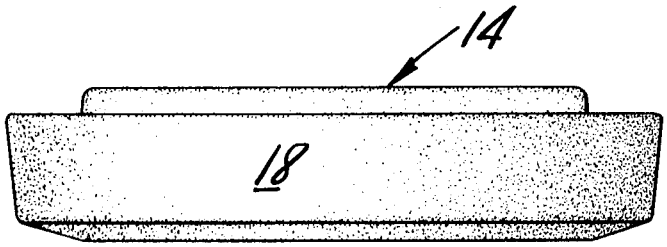
FIG. 5 is a bottom view of the razor.

The razor 10 is embodied in a structure which has as the two integral parts, viz., a handle part 12 and at the upper end of the handle part 12, a blade carrier 14. The handle part it will be noted is an elongated relatively wide-expansed member having a rear panel 16 and a skirt 18 encircling the periphery of the panel and extending forwardly therefrom. Both the panel and the skirt at the lower end as at 20 have a rounded substantially circular configuration whereas the panel and skirt portions diminish in lateral expanse in the direction of the other or upper end of the structure where such panel and skirt have a terminus 22 which extends or is disposed substantially transversely of the long axis of the panel. As can be seen in FIG. 4, the frontally directed skirt portion at the upper end terminus 22 is stepped inwardly as at 24 to provide access for the frontal projection of the razor blade 26 as will be described in detail later.

To enhance the rigidity of the shaving device and to provide a rigidized mounting for the blade 26 in the carrier 14 and further to enhance the appearance of the razor, the same is provided with a plurality of panel stiffening rings 28, 30, 32 which extend frontally from the panel and which are concentric one with the others and with the rounded skirt portion at the lower end of the panel as at 34. Additionally, the center ring 32 encircles a formation of radially directed ribs 36 which appear at both the front and rear side of the panel and which also contribute to strengthening of the panel to prevent flexure of the same particularly since the panel is molded in very thin gauge thermoplastic material. For the purposes of molding the integral one-piece handle and blade carrier, various thermoplastic materials inclusive of polypropylene and polyethylene can be employed, as can polystyrene.

Figure 1:
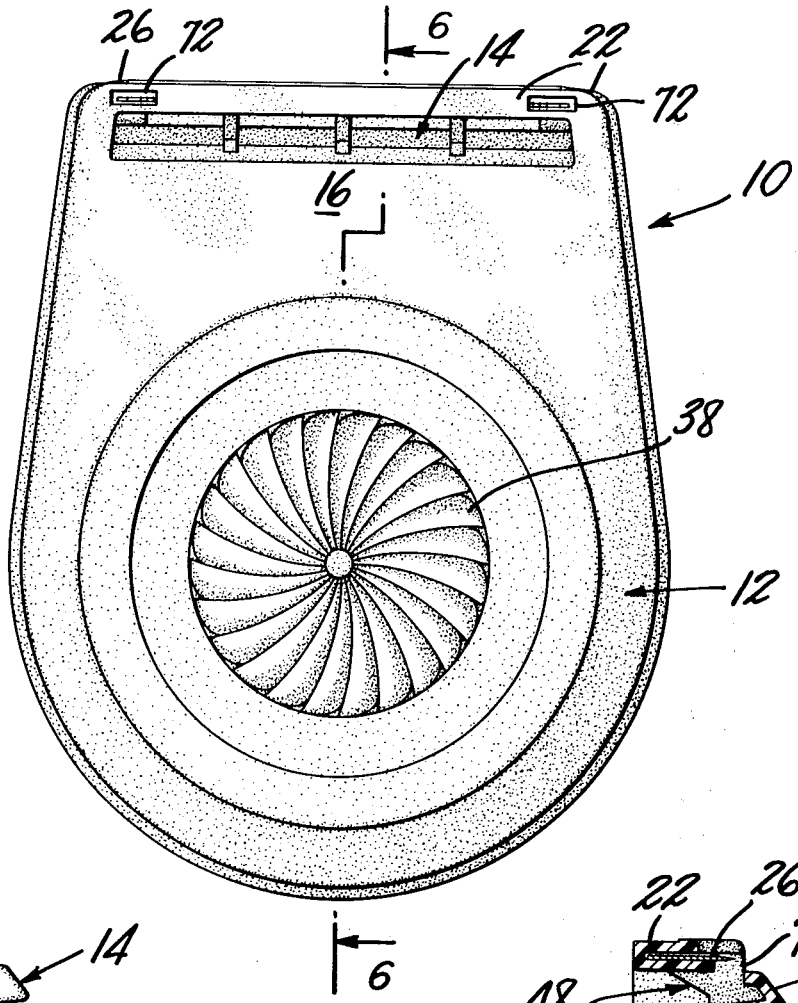
FIG. 1 is a rear elevational view of a disposable razor constructed in accordance with the principles of the present invention.
Figure 3:
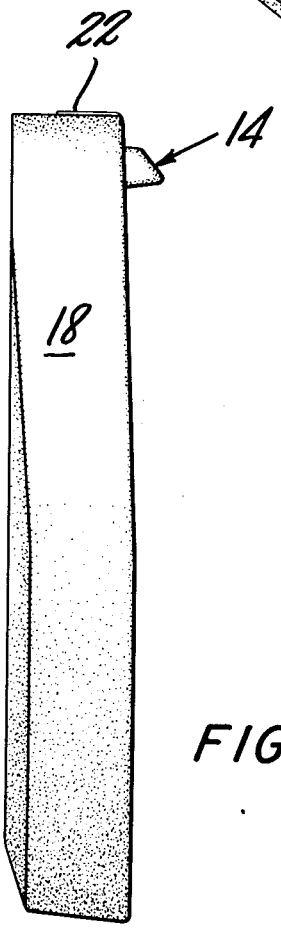
FIG. 3 is a side elevational view of the razor as viewed from the left side in FIG. 2.
Figure 6:
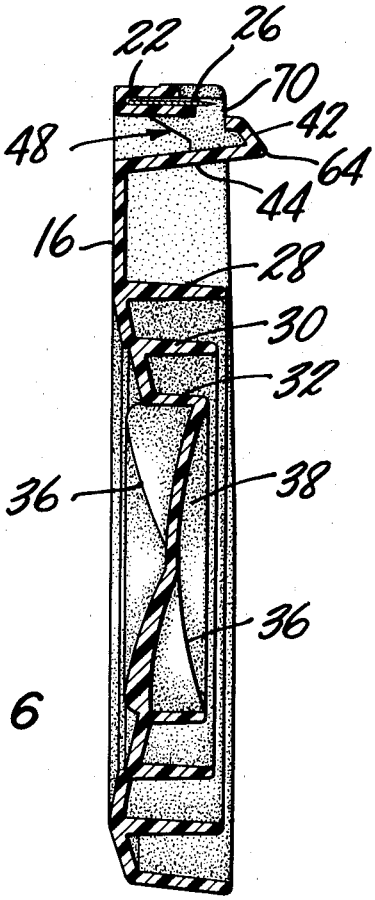
FIG. 6 is a sectional view taken along the line 6—6 in FIG. 1.
Figure 2:
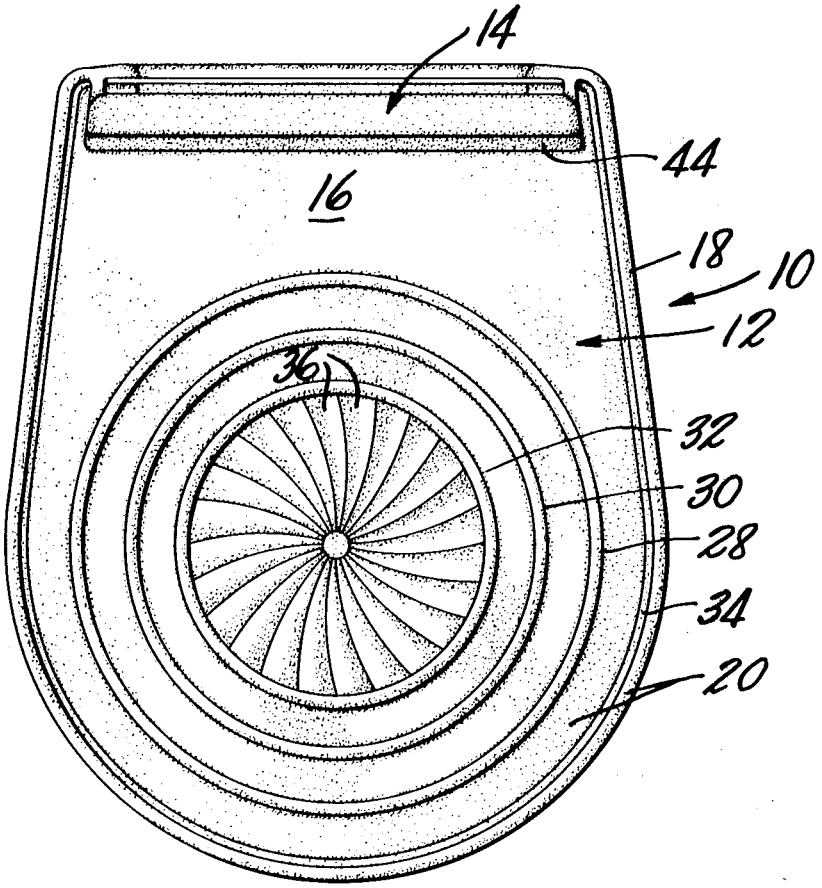
FIG. 2 is a front elevational view of the razor shown in FIG. 1.

The radially disposed ribs 36 also demark a region 38 of depression, as best seen in FIGS. 1 and 6, in the panel which depressed area provides a user finger hold region with which the razor is held in shaving position during use.

As will be appreciated, the razor is of very compact size occupying an area approximately two and one-half by two inches and as such is well suited to be carried conveniently by the user as in a purse.

With reference now to FIGS. 7–10, the blade carrier 14 includes a blade platform 40 which is spaced a distance below the skirt end terminus 22 and provides mounting structure for reception of razor blade 26, the blade platform extending forwardly to provide a guard member 42 which guard member transits into a slightly downwardly inclined rearwardly extending wall part 44 that merges with the rear panel as at 46, there being a plurality of support ribs 48 disposed between the blade platform 40 and said wall part 46 to enhance the rigidity of the blade carrier itself.

Disposed at opposite ends of the blade platform are lugs 50 which engage with companion notches 52 on the opposite ends of the blade and which function along with the ribs 60 formed at the inner surface of the end terminus part 22 to maintain the shaving blade in proper shaving relationship to the guard member, that is, the blade cutting edge 62 is disposed parallel to the front edge 64 of the guard member.

The razor blade depicted is representative of one form of blade that can be employed with the razor, that is it embodies a further guard feature in the form of a wire winding in the manner described in my prior issued U.S. Pat. No. 3,505,734.

In making the razor, the same readily and conveniently can be molded as the single-piece structure described, and following the formation of such structure, the razor blade is inserted through the front opening 70 of the blade carrier and thereafter a positioning tool can be introduced through the openings 72 at the rear of the razor for the purpose of properly positioning the razor blade against the rear surface of the lugs 50. The lugs are incorporated in the invention for several purposes. As shown in FIG. 10, the lugs, which may be molded with the razor as a single-piece structure, have a sloping edge, sloping upwards to the rear as shown at 80. A substantially vertical stop is provided at the rear end of the lug, shown at 82. Ramp 80 on a lug facilitates insertion of the blade from the front, rather than the rear of an opening. Stop 82 prevents the blade from moving forward beyond a particular position, thereby ensuring the safety of the user. A further advantage of the presently described lugs is their use as a stop means during the blade positioning process.

While prior art usage of lugs in cooperation with blade notches is known, the same does not provide for lugs which are integrally molded in a one-piece razor, or for lugs permitting insertion of the blade through the slot opening of the razor. Prior art usage is ordinarily related to a two-piece razor, wherein the lugs are formed on one section, the blade vertically mounted thereon, and the second or cover section subsequently mounted on the blade. The present invention accordingly minimizes the steps required for assembly, as well as providing a safety feature for the user.

Since various changes can be made in the structural detail and relation of parts shown and described herein, and accordingly different embodiments of the invention can be made within the principles thereof, it is intended that all matter contained herein shall be interpreted as illustrative and not in a limiting sense.

What is claimed is:

1. A razor of the disposable type including a handle part and a blade carrier, said carrier and handle part being of integral one-piece molded thermoplastic material construction, the handle including an elongated relatively wide surfaced rear panel, and a skirt encircling the periphery of said rear panel extending frontally therefrom, said panel and its associated skirt extending with diminishing lateral expanse in the direction of one end, the panel and skirt terminus at said one end being disposed transversely of the long axis of the panel, said blade carrier comprising a blade holder substantially enclosed by said panel and skirt terminus and adjacent said one panel end and extending frontally of said panel, said blade holder being arranged parallel with said panel and skirt one end terminus and including a blade platform, a blade received on said platform, a guard member extending frontally of said blade platform, and means carried on said platform and said skirt one end terminus for maintaining said blade fixed in said holder with its cutting edge in predetermined position relative to said guard, said means for maintaining said blade fixed in said holder including a plurality of lugs engageable with corresponding notches on said blade, each of said lugs comprising a first inclined surface, permitting passage of the blade thereover in a first direction, and a second, substantially vertical surface for engaging and locking one of said notches thereby preventing passage of the blade in a second direction, opposite to said first direction, for removal from said blade holder.

2. A razor in accordance with claim 1 in which the expanse of said panel and its associated skirt structure is of rounded, substantially semi-circular configuration at its other end, said rear panel being further provided with at least one panel stiffening ring extending frontally therefrom, with the rounded skirt at said other end of said panel.

3. A razor in accordance with claim 2 in which said panel is provided with a generally centrally located depression in its structure and providing a user finger-hold region with which the razor is held during use.

4. A razor in accordance with claim 1 in which said lugs are located at opposite ends of said blade platform, said notches being located at opposite ends of said blade.

5. A razor in accordance with claim 4 further comprising projections carried at spaced locations on the inner surface of said skirt one end terminus and engaging said blade for urging it against said blade platform.

6. A razor in accordance with claim 1 in which said panel at said one end is provided with an elongated slotted opening, the blade holder being provided with debris openings adjacent and rearwardly of said guard which are in communication with said slotted opening to provide a shaving debris flow course.

7. A razor in accordance with claim 1 in which said blade holder includes a wall part merging from said guard and directed rearwardly therefrom in spaced relation to said blade platform, and a plurality of support ribs extending between said blade platform and said wall part.

8. A razor of the disposable type including a handle part and a blade carrier, said carrier and handle part being of integral one-piece molded thermoplastic material construction, the handle including an elongated rear panel having first and second ends, the panel terminus at said second end being disposed transversely of the long axis of the panel, said blade carrier comprising a substantially enclosed blade holder adjacent said second end and extending frontally of said panel, said blade holder being arranged parallel with said panel terminus and including a blade platform, a blade received on said platform, a guard member extending frontally of said blade platform, and means carried on said platform terminus for permitting insertion of said blade onto said platform from the frontal end of said platform, said means for permitting insertion of said blade onto said platform including a plurality of lugs engageable with corresponding notches on said blade, each of said lugs comprising a first inclined surface, permitting passage of the blade thereover from the frontal end of said platform, and a second, substantially vertical surface for engaging and locking one of said notches thereby preventing passage of the blade in a frontal direction.

9. A razor in accordance with claim 8 wherein said means permitting insertion is integrally formed with said carrier and handle.

10. A razor in accordance with claim 8 wherein said lugs are integrally formed with said carrier and handle, and wherein said inclined surface comprises a gradually tapered frontal surface of said lugs for providing gradual vertical displacement from front to back.

* * * * *